US011472520B2

(12) United States Patent
Cohen et al.

(10) Patent No.: US 11,472,520 B2
(45) Date of Patent: Oct. 18, 2022

(54) TWIST RESISTANT INDEPENDENT RELEASE MOORING SYSTEM

(71) Applicant: United States of America as represented by the Secretary of the Navy, San Diego, CA (US)

(72) Inventors: Nathan David Cohen, Encinitas, CA (US); Nathan Todd Miller, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 161 days.

(21) Appl. No.: 17/109,290

(22) Filed: Dec. 2, 2020

(65) Prior Publication Data

US 2022/0169345 A1 Jun. 2, 2022

(51) Int. Cl.
*B63B 39/02* (2006.01)
*B63B 21/20* (2006.01)

(52) U.S. Cl.
CPC ..... *B63B 39/02* (2013.01); *B63B 21/20* (2013.01)

(58) Field of Classification Search
CPC ..... B63B 39/02; B63B 21/20; B63B 21/22; B63B 21/29; B63B 2021/222
See application file for complete search history.

(56) References Cited

U.S. PATENT DOCUMENTS 3,664,122 A * 5/1972 Linnenbank ..... B63B 21/20 59/93
RE28,746 E * 3/1976 Bruce ..... F16G 13/12 59/84
4,637,335 A * 1/1987 Pollack ..... B63B 21/508 441/4

OTHER PUBLICATIONS

Ross, Steve; Benthic Landers: Critical Tools For Use in Deep-sea Research; Available online at https://oceanexplorer.noaa.gov/explorations/12midatlantic/background/benthiclanders/benthiclanders.html; Estimated publication date: 2012.

* cited by examiner

*Primary Examiner* — Anthony D Wiest
(74) *Attorney, Agent, or Firm* — Naval Information Warfare Center Pacific; Kyle Eppele; J. Eric Anderson

(57) ABSTRACT

A mooring system comprising: a ballast platform; and a chain comprising a plurality of links that are pivotally connected to each other via parallel pivot pins such that the chain is configured to not rotate about a vertical axis that is orthogonal to axes of rotation of the pivot pins, wherein the chain has proximal and distal ends, and wherein the proximal end is attached to a top of the ballast platform and the distal end is configured to be attached to a buoyant object.

20 Claims, 7 Drawing Sheets

TWIST RESISTANT INDEPENDENT RELEASE MOORING SYSTEM

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, Calif., 92152; voice (619) 553-5118; ssc_pac_t2@navy.mil. Reference Navy Case Number 113538.

BACKGROUND OF THE INVENTION

This invention relates to the field of tethered floats. In some scenarios, it is desirable to hold a float at a certain altitude and orientation above the seafloor. Previously, this type of mooring required the use of divers and/or the assistance of a remotely-operated vehicle to deploy and/or recover. There is a need for an improved mooring system that resists rotation of the float.

SUMMARY

Described herein is a mooring system comprising a ballast platform and a chain. The chain comprises a plurality of links that are pivotally connected to each other via parallel pivot pins such that the chain is configured to not rotate about a vertical axis that is orthogonal to axes of rotation of the pivot pins. The chain has a proximal end that is attached to a top of the ballast platform and a distal end that is configured to be attached to a buoyant object.

Another embodiment of the mooring system is disclosed herein that comprises a buoyant object, a chain, a ballast cage, and an acoustic release transponder. The chain comprises a plurality of links, each of which is pivotally connected to adjoining links by parallel pivot pins in such a way so as to inhibit any twisting of the chain between distal and proximal ends of the chain. The distal end of the chain is connected to the buoyant object. The ballast cage is configured to hold ballast weights, and the ballast cage is connected to the proximal end of the chain. The acoustic release transponder is connected between the ballast cage and the ballast weights such that no torsion loads are transferred from the chain to the acoustic release transponder when the ballast cage is resting on a floor of a body of water.

Another embodiment of the mooring system is disclosed herein that comprises a ballast cage, an acoustic release transponder, and a chain. The ballast cage is configured to hold ballast weights. The acoustic release transponder is connected to the ballast cage and configured to release the ballast weights out of a bottom of the ballast cage upon receipt of a given acoustic signal. The chain comprises a plurality of links that are pivotally connected to each other via parallel pivot pins such that the chain is configured to not rotate about a vertical axis that is orthogonal to an axis of rotation of the pivot pins. In this embodiment, the proximal end of the chain is attached to a top of the ballast cage and the distal end is configured to be attached to a buoyant object.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed system below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

References in the present disclosure to "one embodiment," "an embodiment," or any variation thereof, means that a particular element, feature, structure, or characteristic described in connection with the embodiments is included in at least one embodiment. The appearances of the phrases "in one embodiment," "in some embodiments," and "in other embodiments" in various places in the present disclosure are not necessarily all referring to the same embodiment or the same set of embodiments.

As used herein, the terms "comprises," "comprising," "includes," "including," "has," "having," or any variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, un-less expressly stated to the contrary, "or" refers to an inclusive or and not to an exclusive or.

Additionally, use of words such as "the," "a," or "an" are employed to describe elements and components of the embodiments herein; this is done merely for grammatical reasons and to conform to idiomatic English. This detailed description should be read to include one or at least one, and the singular also includes the plural unless it is clearly meant otherwise.

Figure 1:
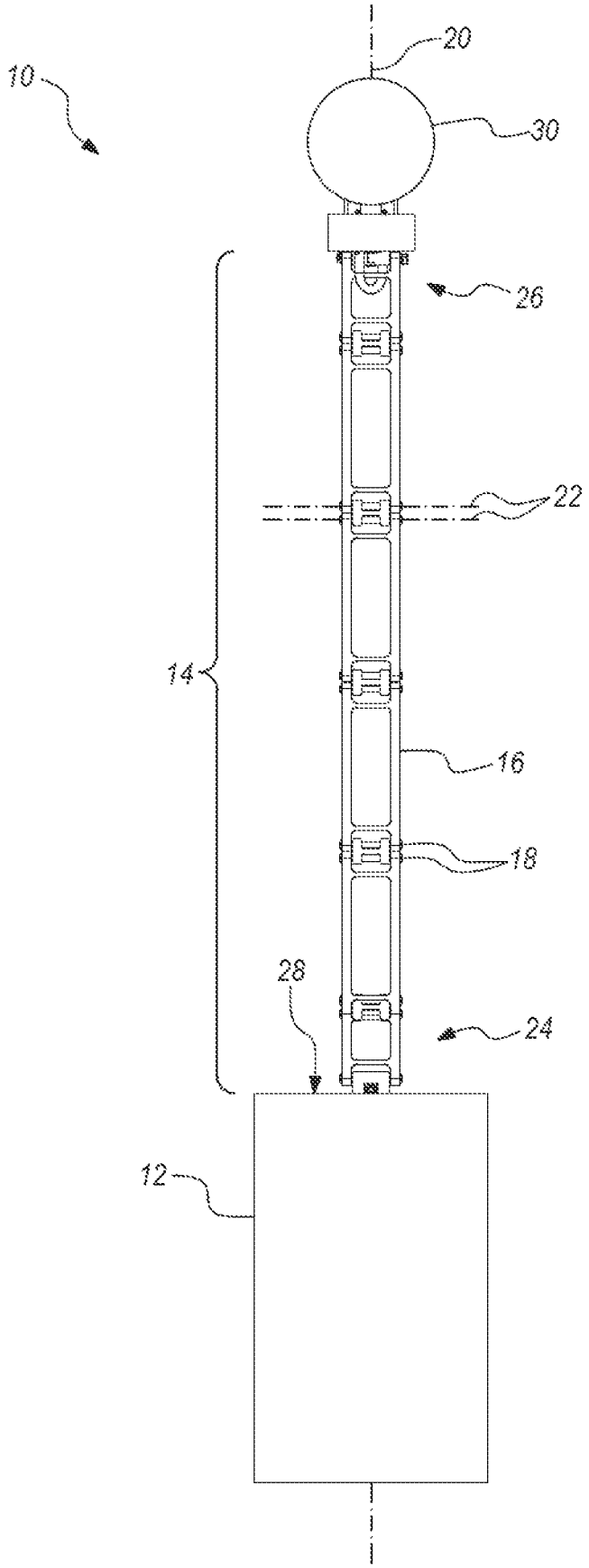
FIG. 1 is a side-view illustration of an embodiment of a mooring system.

FIG. 1 is a side view illustration of a mooring system 10 that comprises, consists of, or consists essentially of a ballast platform 12 and a chain 14. The mooring system 10 provides twist-resistant mooring/anchorage capabilities by providing resistance to rotation about the vertical axis. The chain 14 comprises a plurality of links 16 that are pivotally connected to each other via parallel pivot pins 18 such that the chain 14 is configured to not rotate about a vertical axis 20 that is orthogonal to axes of rotation 22 of the pivot pins 18. The chain 14 has a proximal end 24 that is attached to a top 28 of the ballast platform 12 and a distal end 26 that is configured to be attached to a buoyant object 30. Bushings, not shown, may be mounted to the links 16 to hold the pivot pins 18 so that the pivot pins 18 ride on the bushings. This can be done to avoid having metal to metal contact, to reduce friction, and also to prevent galvanic corrosion. The inside of the chain links 16 may be fabricated with intentional hollows/holes such as is shown in FIGS. 1 and 7C to reduce weight and drag.

The ballast platform 12, which also may be referred to herein as the ballast cage, may be any weight, or container capable of holding a weight, that has a negative buoyancy with respect to the medium in which it is situated. It is envisioned that the mooring system 10 will be most useful in water environments (e.g., seawater, freshwater, brackish water, and brine), but it is to be understood that the mooring system 10 is not limited to water environments, but may also be used in air or other mediums where stable orientation of a platform is desired. Many different configurations and variations are possible.

The chain 14 may be any size or shape where the links all pivot with respect to each other, and where the pivot axes of all link connections are parallel, such that rotation about the vertical axis 20 is minimized. The chain 14 may be made of any material. Suitable examples of material from which the chain 14 may be made include, but are not limited to, plastic, aluminum, stainless steel, and copper-based alloys. The buoyant object 30 may be any object with sufficient buoyancy to fully extend the chain 14 to its full height between the ballast platform 12 and the buoyant object 30. Suitable examples of the buoyant object 30 include, but are not limited to, a surface vessel, a submarine, a lighter-than-air vehicle, a surface buoy, an underwater float, a sensor node, and a balloon.

Figure 2:
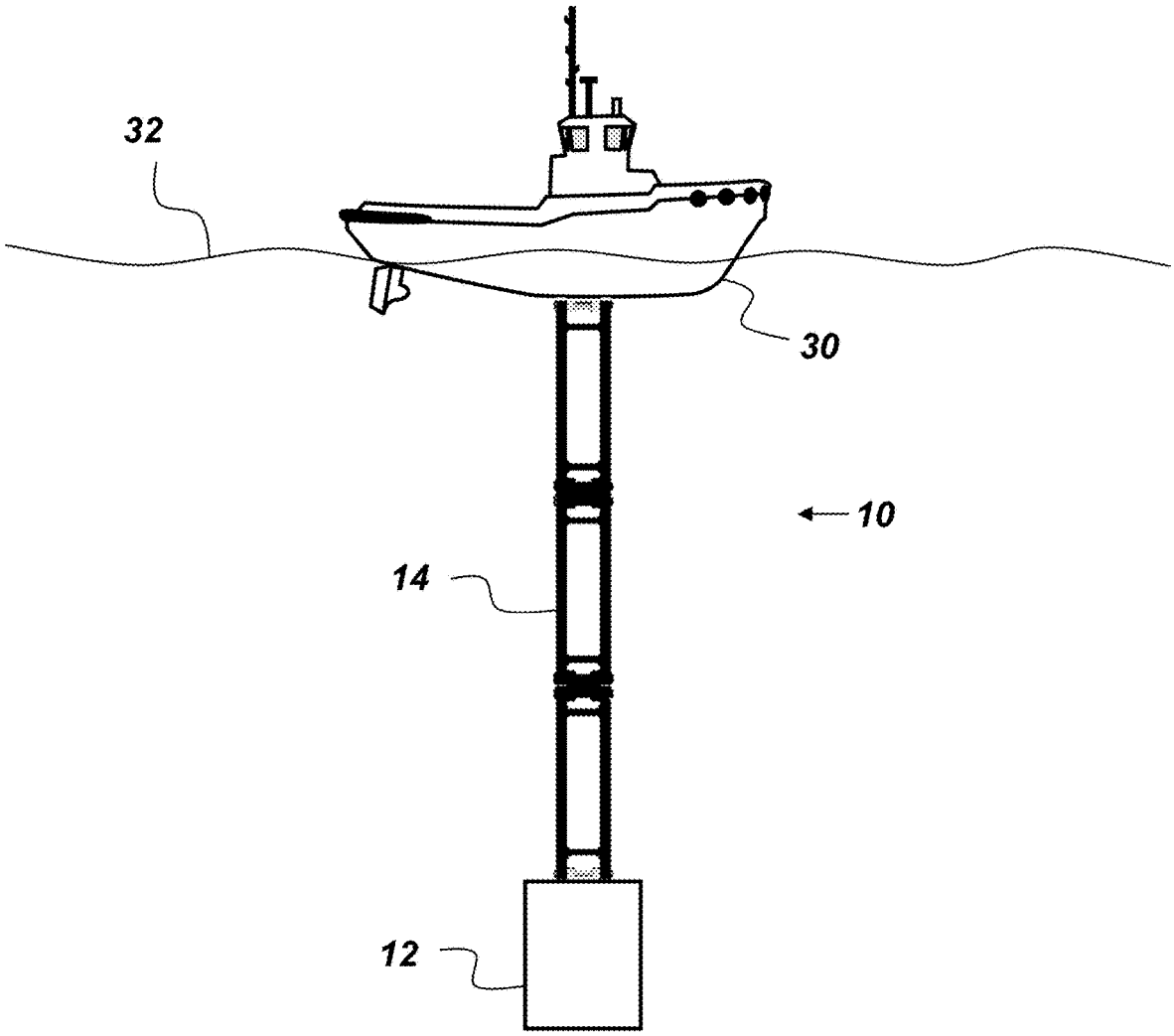
FIG. 2 is a side-view illustration of an embodiment of a mooring system.

FIG. 2 is a side-view illustration of an example embodiment of the mooring system 10 where the buoyant object 30 is an ocean vessel. The line 32 depicts the ocean surface. In the embodiment shown in FIG. 2, the ballast platform 12 may serve as a platform for a sensor or instrument (not shown). The chain 14 resists any twisting due to the shape of the links and the manner in which they are linked together. In this embodiment, the mooring system 10 may be used to hold the ballast platform 12 in a sub-ocean-surface position with a stable orientation with respect to the buoyant object 30, which in this case is a vessel.

FIGS. 3, 4A-4C, and 5 are illustrations of an example embodiment of the mooring system 10, in which the ballast cage 12 is designed to rest on the seafloor 33 of an ocean 36. The buoyant object 30 has a sufficient buoyancy to extend the chain 14, but not to lift the fully-loaded ballast cage 12 off the seafloor 33. This embodiment does not require divers to deploy the mooring system 10 to the seafloor 33. The mooring system 10 may be used in scenarios where it is desirable to hold the buoyant object 30 at a constant altitude above the seafloor 33, in a stable orientation about each axis, and to deploy and recover the buoyant object 30 at a depth beyond conventional SCUBA limits without ROV assistance. The mooring system 10 also does not require the use of separately-anchored lines to maintain a stable orientation of the buoyant object 30. In the embodiment of the mooring system 10 shown in FIGS. 3, 4A-4B, and 6, the buoyant object 30 is a depiction of a lower bulkhead/bottom endcap of a sensor node. However, it is to be understood that the buoyant object 30 can be any desired size or shape so long as it has sufficient buoyancy to keep the chain 14 extended when deployed.

Figure 3:
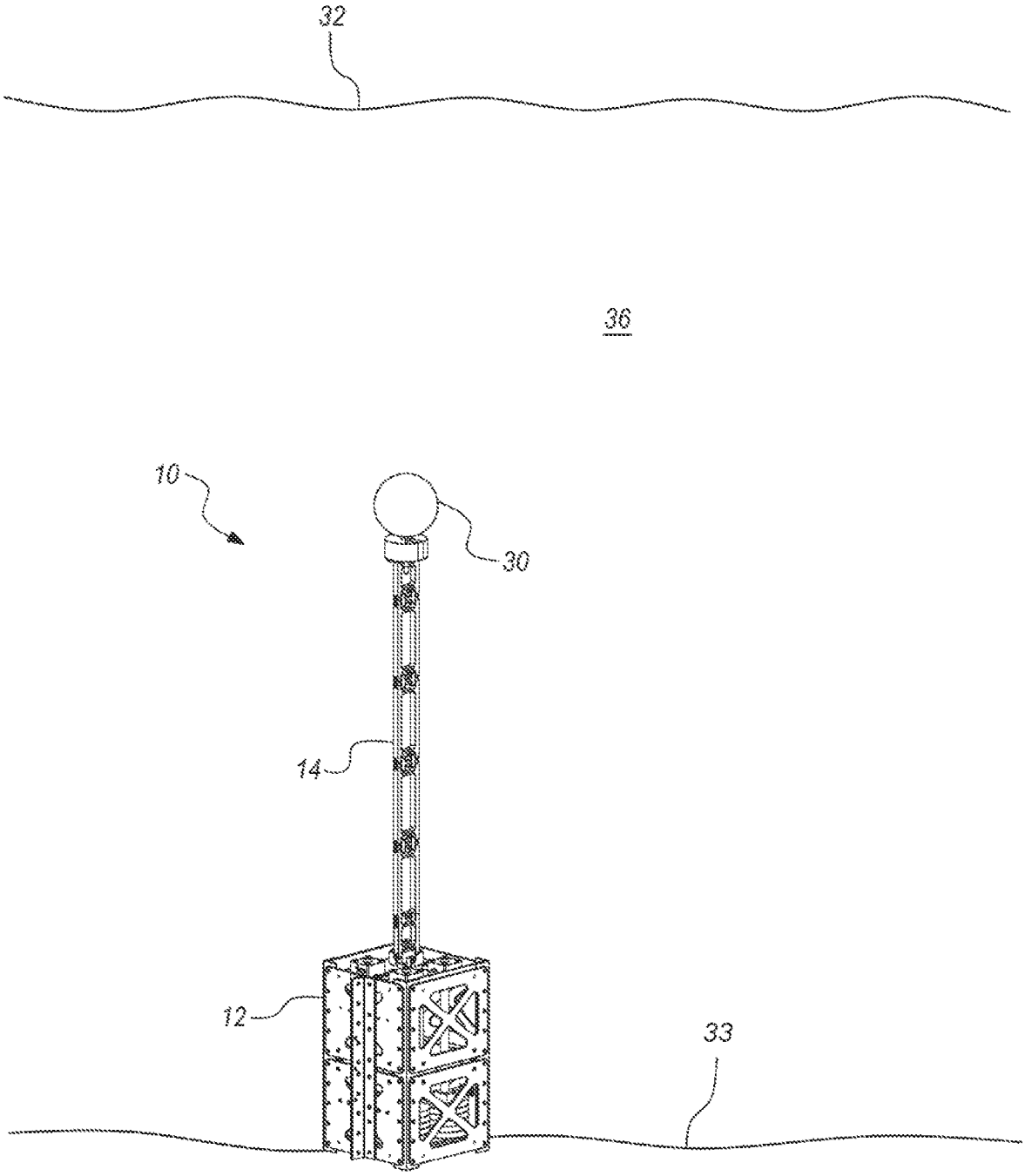
FIGS. 3, 4A and 4B are perspective-view illustrations of an embodiment of a mooring system.
Figure 4A:
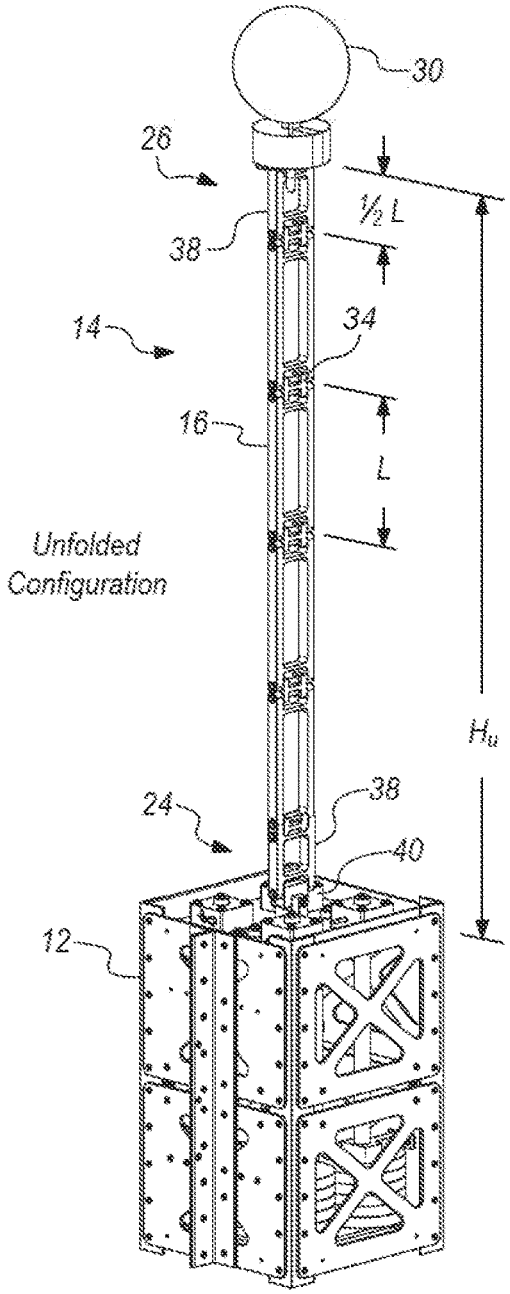
Figure 4B:
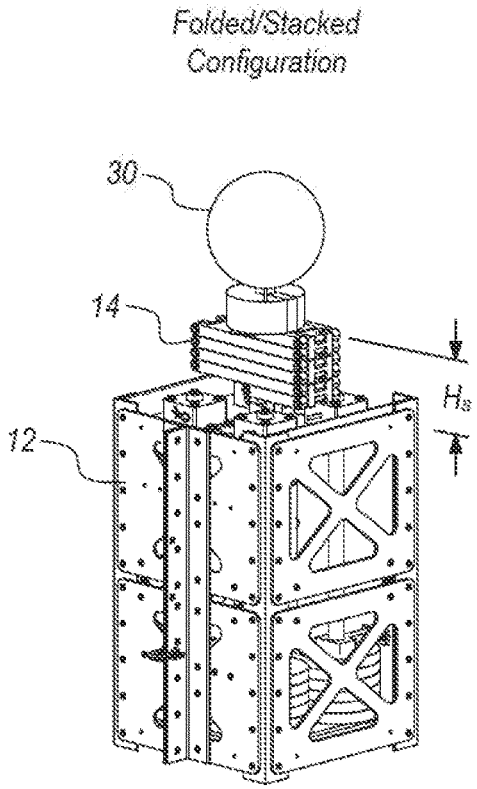

FIGS. 4A and 4B are perspective-view illustrations showing the embodiment of the mooring system 10 of FIG. 3 in unfolded and folded/stacked configurations respectively. In this example of the mooring system 10, the chain 14 is configured to fold and stack on itself as shown in FIG. 4B. In this version of the mooring system 10, the links 16 of the chain 14 are connected to each other via connecting links 34. The folded/stacked configuration of the chain 14 allows for the mooring system 10 to be more easily stored. The collapsible nature of the chain 14 enables the mooring system 10 to be stored in a compact space prior to deployment. Any length of chain 14 may be used depending on the desired application. In one embodiment, the vertical stack of folded chain 14 has a height $H_s$ that is at least twelve times less than a height $H_u$ of the chain 14 in the unfolded configuration.

Figure 4C:
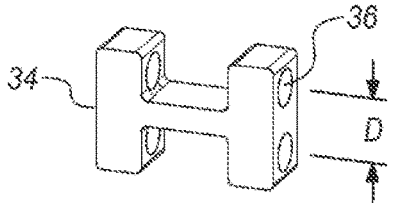
FIG. 4C is a perspective view of a connecting link.

FIG. 4C is a perspective-view illustration of the connecting link 34 shown in FIG. 4A. The distance D between pivot pin holes 36 on each connecting link 34 may be designed such that the primary links 16 may be folded in an alternating pattern to lie one on top of another to form a vertical stack of folded chain such as shown in FIG. 4B. In the example embodiment of the mooring system 10 shown in FIGS. 3, 4A-4C, and 5, the proximal end 24 of the chain 14 is connected to the ballast cage 12 by a half link 38. Similarly, the distal end 26 is connected to the buoyant object 30 by a half link 38. Each half link 38 has a length that is half the length L of a primary link 16 such that when the chain 14 is folded the vertical stack of folded chain 14 is centered over the ballast cage connection point 40.

Figure 5:
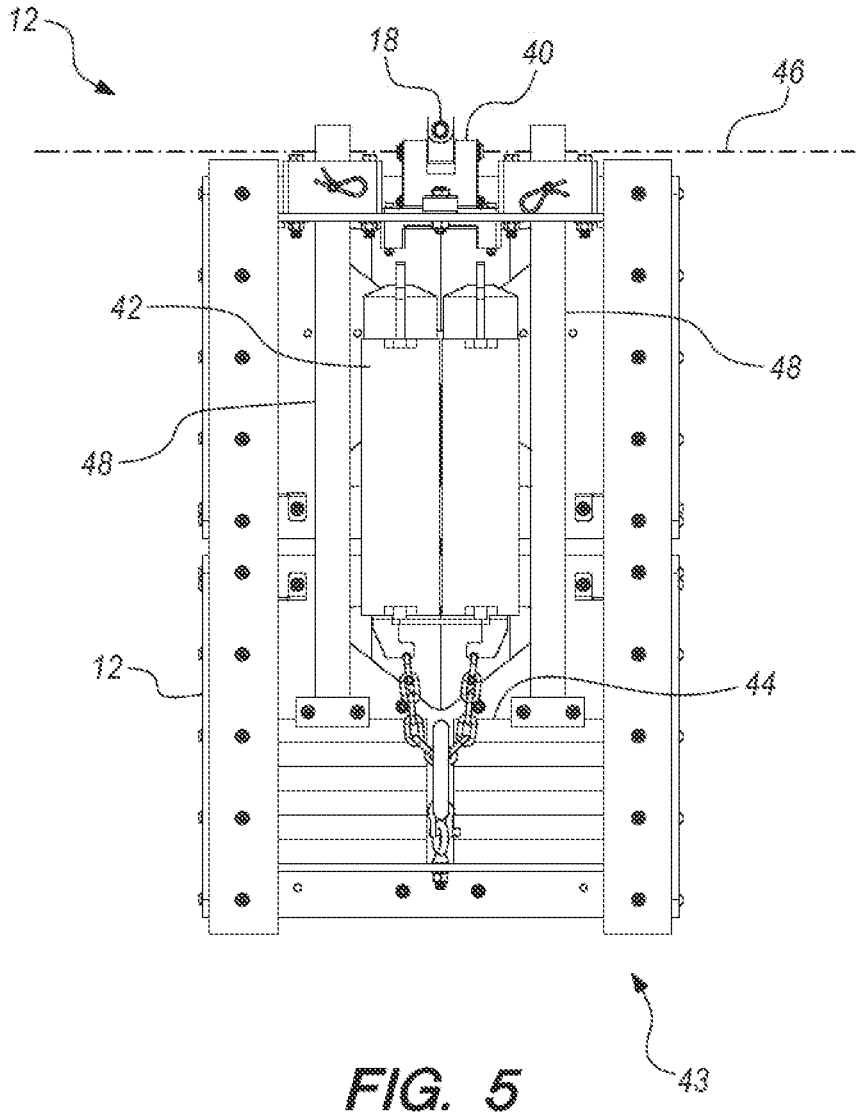
FIG. 5 is a cut-away, side-view of an embodiment of a ballast cage.

FIG. 5 is a cut-away, side-view illustration of the ballast cage 12 shown in FIG. 3. In this embodiment, the mooring system 10 further comprises an acoustic release transponder 42 that is housed within the ballast cage 12 and connected between the ballast cage 12 and ballast weights 44 such that no torsion loads are transferred from the chain 14 to the acoustic release transponder 42 when the ballast cage 12 is resting on the seafloor 33. This embodiment of the ballast cage 12 only allows the transfer of tensile loads (not torsional) to the acoustic release transponder 42. The acoustic release transponder 42 may be configured to release the ballast weights 44 out of a bottom end 43 of the ballast cage 12 upon receipt of a given acoustic signal. Optionally, the acoustic release transponder 42 and ballast weights 44 may be configured to pivot within the ballast cage 12 such that they hang vertically within the cage even if the cage comes to rest on an uneven surface. In the embodiment of the ballast cage 12 shown in FIG. 5, the ballast weights 44 are a stack of barbell weight plates that are held on rails 48 by the acoustic release transponder 42. Again, any desired size/shape/weight may be used for the ballast weights 44 depending on the desired application.

The buoyant object may be selected to have a buoyancy that is greater than the combined weight of the chain 14, the acoustic release transponder 42, and the ballast cage 12 when empty. It is also desirable that the buoyant object 30 have a buoyancy that is less than the combined weight of the chain 14, the acoustic release transponder 42, and the ballast cage 12 when holding the ballast weights 44. Upon release of the ballast weights 44, the buoyant object 30 should have sufficient buoyancy to lift the chain 14, the ballast cage 12, and the acoustic release transponder 42 off of the seafloor 33. In most embodiments, the buoyant object 30 will be capable of lifting the mooring system 10 to the surface 32, but it is to be understood that there may be operational scenarios where it will be desirable to configure the buoyant object 30 to lift the mooring system 10 off of the seafloor 33, but not raise it all the way to the surface 32. The acoustic release transponder 42 may be any release device capable of releasing the ballast weights 44 upon receiving a given acoustic signal. In some embodiments, a dual acoustic release system, as is known in the art, may be used to provide redundancy such that as long as one release actuates, the ballast weights 44 will be released. It is to be understood that other release mechanisms besides acoustic release transponders may be used as part of the mooring system 10. For example, a power cable may be run to the ballast cage 12 and a release may be used that is triggered by a signal transmitted over this cable. Other suitable release mechanisms include, but are not limited to, galvanic releases, timers, pressure-sensitive triggers, and other releases as are known in the art.

Figure 6:
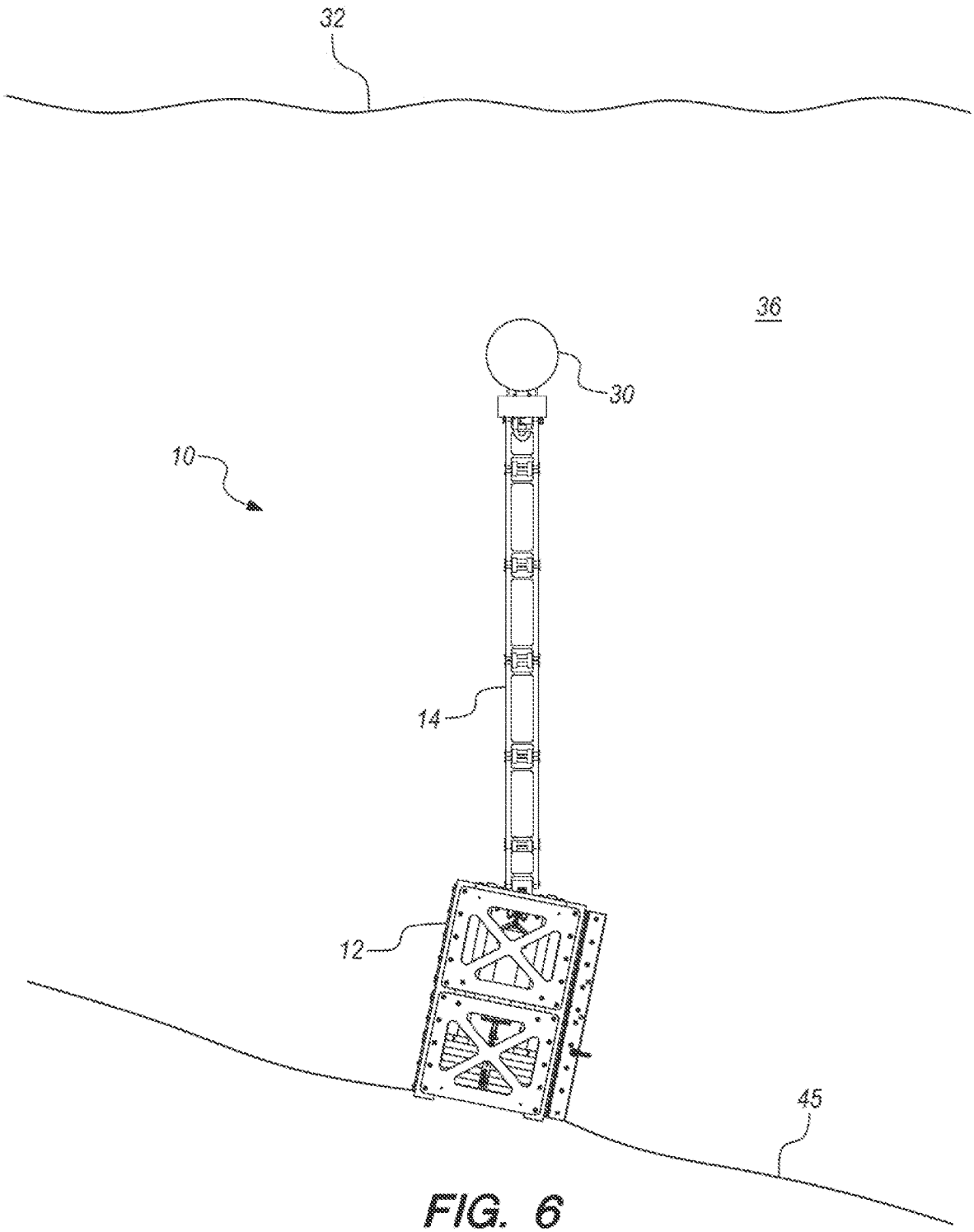
FIG. 6 is a side-view illustration of an embodiment of a mooring system.

In one example embodiment of the mooring system 10, the links 16 are made of hard anodized 6061-T6 aluminum, and the pivot pins 18, which are held in place by retaining rings, are made of hard anodized 7075-T6 aluminum. An RC9 "loose running fit" clearance in some embodiments is desirable between the pivot pins 18 and the links 16, or rather between the pivot pins 18 and the bushings, if bushings are used between the pivot pins 18 and the links 16. Also, in one embodiment of the mooring system 10, a secondary float may be attached to the buoyant object 30 via a separate release (e.g., acoustic, galvanic, timed, etc.) to slow the descent of the mooring system 10. In one example embodiment of the mooring system 10, the ballast cage connection point 40 is configured to pivot about an axis 46 that is perpendicular to the pivot pins 18 such that the chain 14 extends vertically from the ballast cage 12 when the ballast cage 12 comes to rest on a sloped underwater surface 45, such as shown in FIG. 6.

Figure 7A:
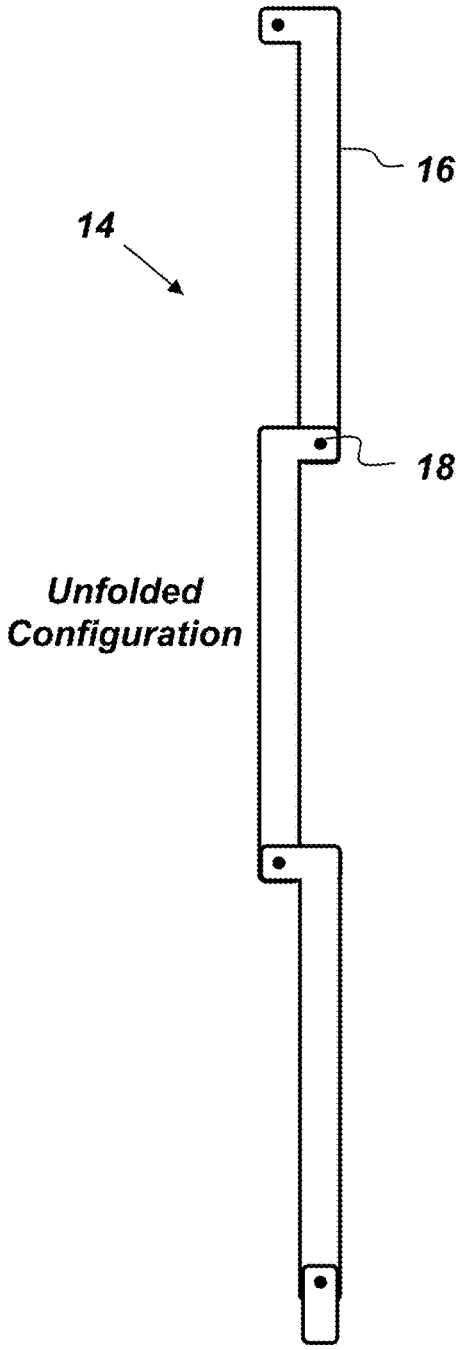
FIGS. 7A and 7B are side-view illustrations of an embodiment of a folding chain.
Figure 7B:
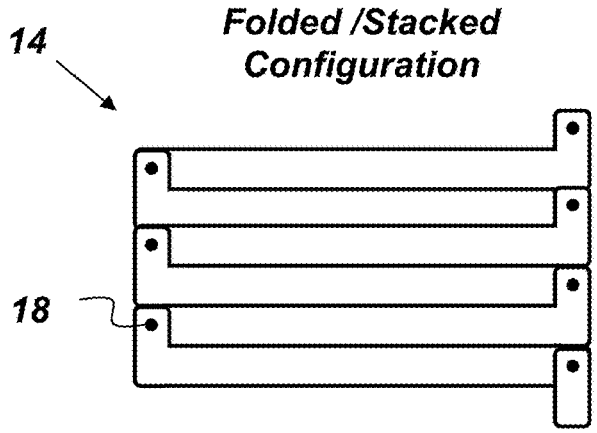
Figure 7C:
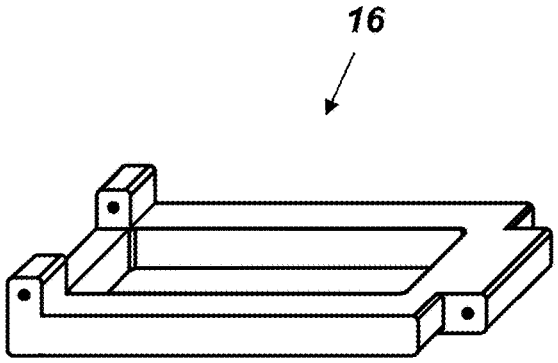
FIG. 7C is a perspective-view illustration of an embodiment of a folding chain link.

FIGS. 7A-7C are illustrations of another embodiment of the chain 14. FIGS. 7A and 7B are side-views of this embodiment of the chain 14 in extended and folded configurations respectively. FIG. 7C is a perspective view of one link 16 of this alternative embodiment of the chain 14.

From the above description of the mooring system 10, it is manifest that various techniques may be used for implementing the concepts of the mooring system 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the mooring system 10 is not limited to the particular embodiments described herein, but is capable of many embodiments without departing from the scope of the claims.

We claim:

1. A mooring system comprising:

a ballast platform; and a chain comprising a plurality of adjoining links that are pivotally connected to each other via parallel pivot pins such that the chain is configured to not rotate about a vertical axis that is orthogonal to axes of rotation of the pivot pins, wherein the chain has proximal and distal ends, and wherein the proximal end is attached to a top of the ballast platform and the distal end is configured to be attached to a buoyant object.

2. The mooring system of claim 1, wherein the chain is made of a material selected from the group consisting of: plastic, aluminum, stainless steel, and copper-based alloys.

3. A mooring system comprising a buoyant object;

a chain comprising a plurality of links, wherein each link is pivotally connected to adjoining links by parallel pivot pins so as to inhibit any twisting of the chain between distal and proximal ends of the chain, and wherein the distal end is connected to the buoyant object;

a ballast cage configured to hold ballast weights, wherein the ballast cage is connected to the proximal end; and an acoustic release transponder connected between the ballast cage and the ballast weights such that no torsion loads are transferred from the chain to the acoustic release transponder when the ballast cage is resting on a floor of a body of water.

4. The mooring system of claim 3, wherein the chain is configured to fold and stack on itself.

5. The mooring system of claim 3, wherein the plurality of links comprises primary links connected to each other via connecting links, wherein the distance between pivot pin holes on each connecting link is such that the primary links may be folded in an alternating pattern to lie one on top of another to form a vertical stack of folded chain.

6. The mooring system of claim 5, wherein the proximal end is connected to the ballast cage by a half link, wherein the half link has a length that is half the length of a primary link such that when folded, the vertical stack of folded chain is centered over a ballast cage connection point.

7. The mooring system of claim 6, wherein the buoyant object is connected to the chain via another half link.

8. The mooring system of claim 6, wherein the ballast cage connection point is configured to pivot about an axis that is perpendicular to the pivot pins such that the chain extends vertically from the ballast cage when the ballast cage comes to rest on a sloped underwater surface.

9. The mooring system of claim 3, wherein the buoyant object is a surface buoy.

10. The mooring system of claim 3, wherein the buoyant object is a sensor node that is configured to hold a stable orientation and altitude in a sub-surface position in a body of water.

11. The mooring system of claim 3, wherein the links are shaped so as to lie flat, one-on-top-of-the-other, when in a folded configuration.

12. A mooring system comprising:

a ballast cage configured to hold ballast weights;

an acoustic release transponder connected to the ballast cage and configured to release the ballast weights out of a bottom of the ballast cage upon receipt of a given acoustic signal; and a chain comprising a plurality of adjoining links that are pivotally connected to each other via parallel pivot pins such that the chain is configured to not rotate about a vertical axis that is orthogonal to an axis of rotation of the pivot pins, wherein the chain has proximal and distal ends, and wherein the proximal end is attached to a top of the ballast cage and the distal end is configured to be attached to a buoyant object.

13. The mooring system of claim 12, wherein the links are shaped so as to lie flat, one on top of the other, when in a folded configuration.

14. The mooring system of claim 12, wherein the plurality of links comprises primary links connected to each other via connecting links, wherein the distance between pivot pin holes on each connecting link is such that the primary links may be folded in an alternating pattern to lie one on top of another to form a vertical stack of folded chain.

15. The mooring system of claim 14, wherein the vertical stack of folded chain has a height that is at least twelve times less than a height of the chain in an unfolded configuration.

16. The mooring system of claim 12, wherein the buoyant object is a surface buoy and the ballast cage is configured to rest on a floor of a body of water.

17. The mooring system of claim 12, wherein the buoyant object has a buoyancy that is greater than the combined weight of the chain, the acoustic release transponder, and the ballast cage when empty, and wherein the buoyancy of the buoyant object is less than the combined weight of the chain, the acoustic release transponder, and the ballast cage when holding ballast weights.

18. The mooring system of claim 12, wherein the buoyant object is configured to maintain a sub-surface position with a stable orientation and altitude within a body of water when the ballast cage is resting on a floor of the body of water.

19. The mooring system of claim 18, wherein the buoyant object is an ocean vessel, and wherein the ballast platform is configured to hold a stable orientation in a sub-surface position in a body of water.

20. The mooring system of claim 12, wherein the pivot pins ride in bushings mounted in the links.

* * * * *